United States Patent [19]

Erling

[11] Patent Number: 4,887,300

[45] Date of Patent: Dec. 12, 1989

[54] PRESSURE GRADIENT MICROPHONE

[75] Inventor: Frederiksen Erling, Holte, Denmark

[73] Assignee: Aktieselskabet Bruel & Kjaer, Naerum, Denmark

[21] Appl. No.: 165,273

[22] PCT Filed: Jun. 25, 1987

[86] PCT No.: PCT/DK87/00081

§ 371 Date: Mar. 7, 1988

§ 102(e) Date: Mar. 7, 1988

[87] PCT Pub. No.: WO88/00787

PCT Pub. Date: Jan. 28, 1988

[51] Int. Cl.[4] ..... H04R 19/04; H04R 19/00

[52] U.S. Cl. ..... 381/168; 381/174; 381/191

[58] Field of Search ..... 381/168, 169, 173, 174, 381/191, 92, 113, 155

[56] References Cited

U.S. PATENT DOCUMENTS

| | | | |
|---|---|---|---|
| 3,588,382 | 6/1971 | Reedyk | 381/173 |
| 3,944,756 | 3/1976 | Lininger | 381/174 |
| 4,258,235 | 3/1981 | Watson | 381/174 |
| 4,559,418 | 12/1985 | Imai | 381/173 |

FOREIGN PATENT DOCUMENTS

| | | | |
|---|---|---|---|
| 489110 | 1/1976 | Australia . | |
| 2110054 | 6/1983 | United Kingdom . | |
| 2112605 | 7/1983 | United Kingdom . | |
| 2177798A | 1/1987 | United Kingdom | 381/168 |

*Primary Examiner*—Jin F. Ng
*Assistant Examiner*—Danita R. Byre
*Attorney, Agent, or Firm*—Cushman, Darby & Cushman

[57] ABSTRACT

Pressure gradient microphone comprising a membrane (2) and a back electrode (4), the latter being provided with a film (6) of an electret material divided into semicircular sections, one of them being provided with a permanent electrostatic charge. The back electrode is supplied with an inverse potential by means of an external, adjustable voltage source. As a result the pressure gradient microphone is able to subtract two almost equal values from each other so as to indicate the pressure difference and consequently the pressure gradient with greater accuracy than previously known.

6 Claims, 4 Drawing Sheets

$$|C| = \sqrt{A^2 + B^2}$$

$$\tan \Phi = \frac{B}{A}$$

PRESSURE GRADIENT MICROPHONE

TECHNICAL FIELD

The present invention relates to a pressure gradient microphone comprising a membrane and a back electrode the surface of either the membrane or the back electrode being a film of an electrostatically charged, electret material divided into preferably semicircular sections.

BACKGROUND ART

The U.S. Pat. No. 3,588,382 describes a pressure gradient microphone of the electret type with the electret being divided into semicircular sections, said sections being positively or negatively charged. It is difficult to manufacture good pressure gradient microphones according to this principle for measuring purposes. Such microphones are, apart from being sensitive to pressure gradients, also sensitive to pressure, i.e. to pressure equally distributed all over the membrane. The polarized sections divide the microphone into separate transducer sections, each section contributing to the signal of the microphone. Ideally, the contributions of the sections should neutralize each other with equal pressure all over the membrane whereby the microphone should transmit no signal. Due to different charges, unequal distances between the membrane and the charged sections, unequally distributed membrane voltages etc. between the components this can never be achieved in practice. That is why such pressure gradient microphones are not used for the acoustic measuring of particle speed and sound intensity, although it would be an advantage compared to the state of the art.

DESCRIPTION OF THE INVENTION

An electret microphone of the above type is according to the invention characterised by only some of the sections being permanently charged, the back electrode being electrically charged by means of an adjustable external voltage source.

In a pressure gradient microphone provided with a permanent charge as well as with a charge from an external voltage source, the pressure sensitivity can be adjusted to zero by adjusting the voltage source, while the membrane is supplied with equal pressure. The external voltage source is used for outbalancing the differences in all other important parameters. As a result the pressure sensitivity is reduced by a factor 10 or more compared to microphones with two permanent charges.

The electret microphone may be improved and become more easily adjustable, if the chamber of the microphone is so small that the deflection of the membrane is considerably reduced under equal pressure on the two halves.

In a preferred embodiment the electret microphone comprises four back electrode parts interconnected two by two for measuring the pressure gradient in one plane.

Measuring the pressure gradient is important because this parameter can be used for determining particle speed and sound intensity. Both values are of great interest in connection with acoustic measurements.

A pressure gradient microphone according to the present invention is on the outside formed like a typical microphone for measuring pressure. By placing such a pressure gradient microphone opposite a pressure microphone of the same outer size and form in such a way that their membranes are placed opposite to each other, an especially advantageous intensity measuring probe is obtained, since the pressure and particle speed can be determined within the same small area.

BRIEF DESCRIPTION OF THE DRAWINGS

The invention will be described in greater details below with reference to the accompanying Figures, in which.

DESCRIPTION OF THE PREFERRED EMBODIMENTS OF THE INVENTION

Figure 1:
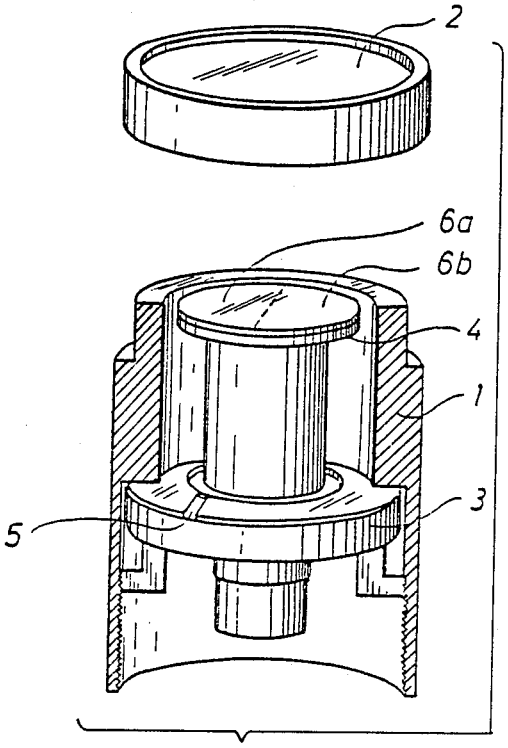
FIG. 1 shows an electret microphone according to the invention for measuring pressure gradients.

The microphone shown in FIG. 1 comprises an outer microphone housing 1 formed substantially like a cylindric component. The microphone housing 1 is provided with a membrane unit 2 including a short cylindrical sleeve with a flange stretching the membrane together with the microphone housing. The membrane 2 is the movable electrode of the microphone. The membrane unit 2 is screwed or in an other way fastened to the microphone housing 1 so as to establish an electrically conductive connection between the housing 1 and the membrane 2. The inside of the microphone housing is provided with a recess with a contact surface for a disc-shaped insulator 3. The insulator 3 is kept in its position in the microphone housing 1 by means of a spring washer at a thread on the inside of the housing.

A stationary electrode 4, referred to as back electrode, is situated on the insulator 3. This electrode includes a head with a plane surface being the actual stationary capacitor plate, and a cylindrical part extending through the insulator 3 and into a terminal of a electrically well-conducting material. The membrane unit 2, the microphone housing 1, the back electrode 4 and the insulator 3 thus enclose a chamber only communicating with the ambient through a pressure compensating channel 5. This channel can be established in several ways. In some microphones the pressure compensating channel is obtained by means of a bore in the wall of the microphone housing, and the necessary acoustic resistance is subsequently obtained by leading a wire of a suitable thickness through the channel.

Figure 2:
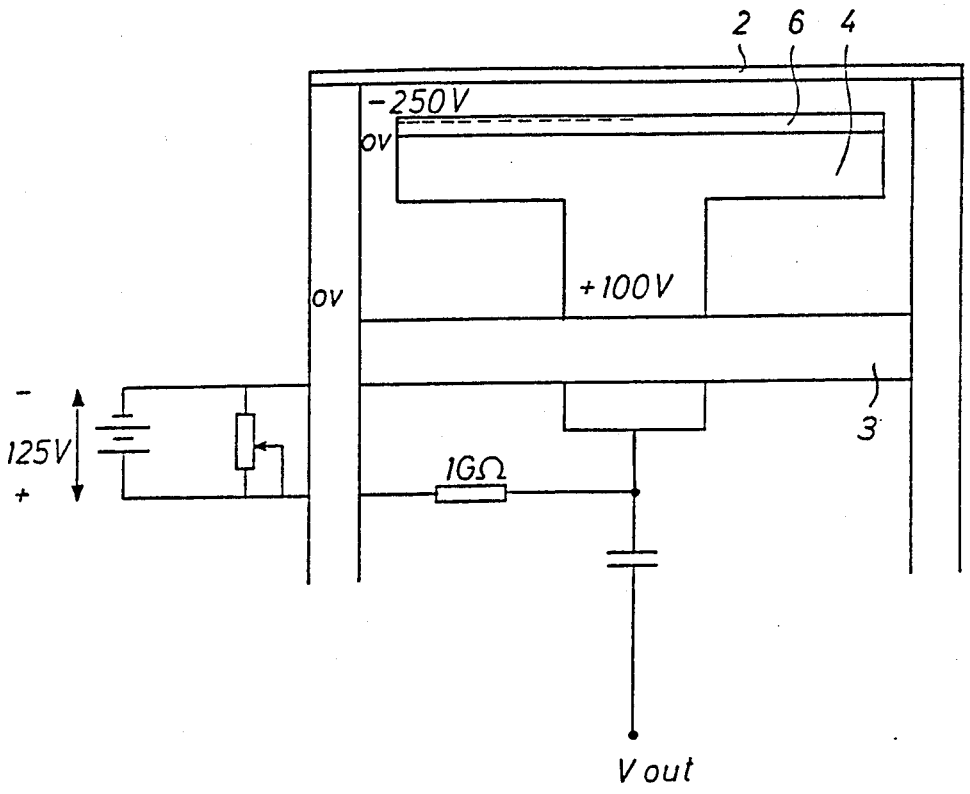
FIG. 2 shows the electric circuit diagram to be used in connection with the pressure gradient microphone.

The back electrode 4 is provided with a film 6 of electrostatically charged, electret material. The film optionally of a thickness of approx. 10–20 μm is divided into two semicircular sections 6*a* and 6*b*. Only one of the semicircular sections is electrostatically charged (e.g. negatively charged) to a potential of e.g. −250 V in proportion to the back electrode 4, cf. FIG. 2. The principle of the invention is that the back electrode is supplied with a potential of +125 V in proportion to the membrane 2. Thus one half of the film 6 has a potential of −125 V in relation to the membrane 2, while the other half of the film 6 has a potential of +125 V in relation to the membrane 2, and these potentials can be finely adjusted in order to equalize distortions by means of a potentiometer connected in parallel to an external voltage source. The adjustment is performed by subjecting all the membrane 2 to an equal pressure and then adjusting to minimum ouptput signal. This adjustment compensates for the lack of symmetry in the mechanical structure. It is easier to compensate for undesirable signals if the chamber of the microphone is so small that the deflection of the membrane is considerably reduced by an equal pressure on the two halves. As a result a pressure gradient microphone is able to subtract two almost equal measuring values from each other and thus indicate the pressure difference and consequently the pressure gradient with greater accuracy than previously known. The output signal is delivered by the back electrode at $V_{ud}$.

The above pressure gradient microphone indicates a pressure gradient in one direction, i.e. along the surface of the membrane in a direction perpendicular to the dividing line between the two semicircular sections.

Figure 4A:
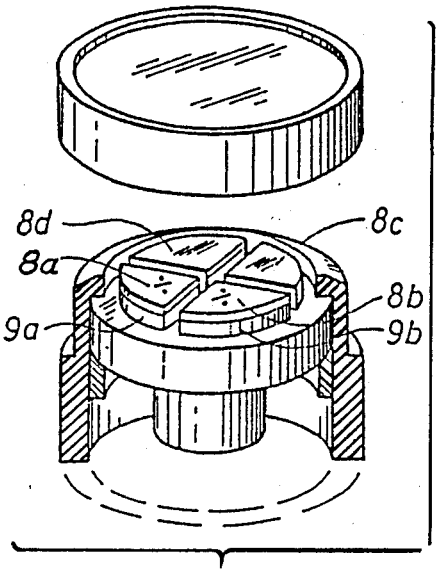
FIGS. 4*a*–4*c* show a pressure gradient microphone with its electric circuit diagram indicating the direction of propagation of the sound in one plane.
Figure 4B:
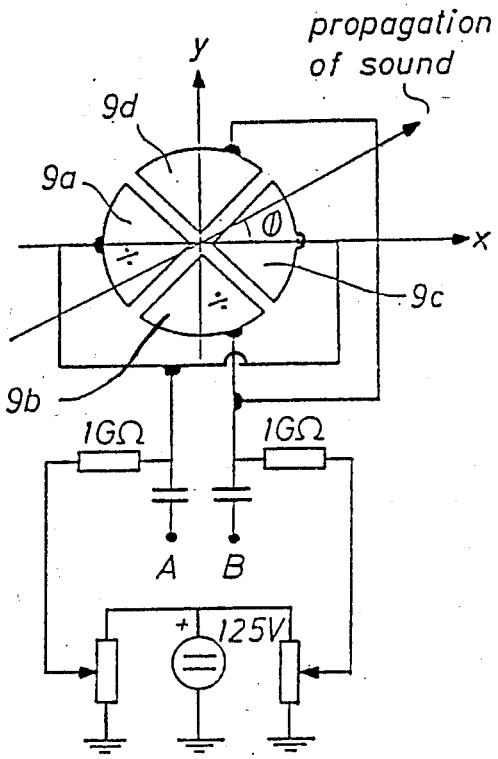
Figure 4C:
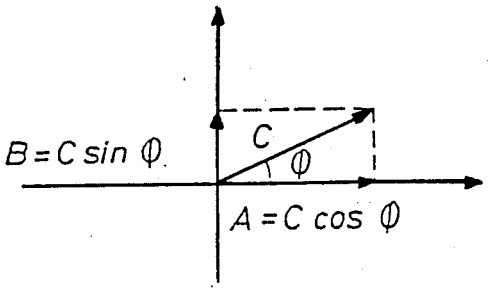

Another preferred embodiment is provided with e.g. four quadrant-shaped back electrode parts interconnected two by two for indicating the direction of propagation of the sound in one plane. FIG. 4*a* shows the separated microphone where the four electrode parts with coatings 8*a*, 8*b*, 8*c*, 8*d* of electret material are visible. Two of these coatings 8*a*, 8*b* are electrostatically charged (negatively). FIG. 4*b* shows, how the electrode parts 9*a*, 9*b*, 9*c*, 9*d* are interconnected two by two, the individual set of electrodes being adjusted by means of a separate potentiometer connected in parallel to a voltage source of 125 V. Furthermore FIG. 4*b* shows an XY coordinate system with an example of sound propagation in relation to this coordinate system. FIG. 4*c* illustrates how the direction of propagation of the sound is computed in relation to one axis of the coordinate system using the signal values measured at A and B. The advantage of this microphone is that turning the microphone for maximum sensitivity is avoided. By means of two microphone placed perpendicular to each other the direction of propagation in sapce can furthermore be indicated.

An electrostatic measuring grid divided into semicircular sections insulated from each other can be placed in front of the microphone for calibrating purposes, said sections corresponding to the divisions of the back electrode. By means of suitable differences in phase between the electric signals, the grid is used to electrically simulate a sound wave propagating across the pressure gradient microphone.

Figure 3:
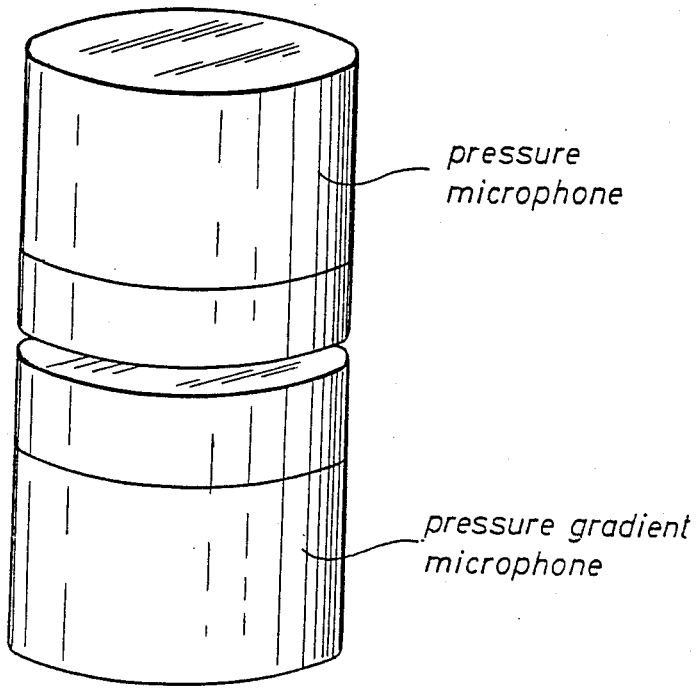
FIG. 3 shows a pressure gradient microphone in connection with a pressure microphone for measuring sound intensity.

A pressure gradient microphone can advantageously be placed opposite a pressure microphone so as to provide a relatively thin gap between the microphones, cf. FIG. 3. As a result a sound intensity I dependant on the pressure P and the difference in pressure can be measured.

The sound intensity can be measured by means of:

(1) PRESSURE MICROPHONES (2) A PRESSURE MICROPHONE and A PRESSURE GRADIENT MICROPHONE The mean value in time of the sound intensity—in a point l and in a direction r—is defined by the pressure p(t) in the point and by the particle speed in the direction $u_r(t)$, such that $$I_r=\overline{p(t)\cdot u_r(t)}$$

(the line indicating mean value in time)

METHOD 1

The pressure microphones are a part of a sound intensity probe, said microphones being mounted at a predetermined intervals. During the intensity measurement the central point between the microphones is placed in the measuring point of the sound field.

By this method the pressure p(t) in the measuring point is represented by half the sum of the pressures measured by the microphones, i.e. by the expression:

$$\frac{p_1(t)+p_2(t)}{2}$$

This half sum is computed in the measuring apparatus.

The difference between the pressures in part of the expression shown below representing the particle speed $u_r(t)$ in the measuring point. The difference is computed in the measuring apparatus.

For the sound field the following applies:

$$p_1(t)-p_5(t)=\Delta r\cdot\rho\cdot a_r(t)$$

$$\Delta r<<\text{wavelength}/2)$$

$\Delta r$: point distance/microphone distance $\rho$: density of air $a_r(t)$: particle acceleration in the direction r The particle speed is represented by $$a_r(t)dt=\frac{p_1(t)-p_2(t)}{\Delta r_0\cdot \text{rho}_0}\,dt$$

$\Delta r_0$: value for distance between microphones (programmed into the measuring system)

$\rho_0$: value for the density of the air (programmed into the measuring system)

The result of the intensity measurement is consequently:

$$I_r=\frac{p_1(t)+p_2(t)}{2}\int\frac{p_1(t)-p_2(t)}{\Delta r_0\cdot \text{rho}_0}\,dt$$

It can be shown that the intensity measured for a sine wave is:

$$I_r=\frac{P_1\cdot P_2}{2\cdot \text{rho}_0\cdot c}\;\frac{\sin(w\cos A\cdot\Delta r/c)}{w\,\Delta r_0/c}\quad\text{where}$$

$P_1$, $P_2$ are peak values of the pressures in the measuring points of the microphones, w is the angular frequency, A is the angle between the direction of propagation of the sound and the probe axis and c is the speed of sound in the actual field.

If the probe is placed in a plane sound wave with its axis in the direction of propagation (A=0) and if the input $\rho_0$ and $\Delta r_0$ corresponds to the values of $\rho$ and $\Delta r$, the left-hand fraction of the measuring result expresses the real intensity of the field while the right-hand fraction is the frequency characteristics of the system representing the measuring error applying to this method, method 1.

METHOD 2

The pressure difference microphone measures the pressure difference between two points. The pressure microphone is positioned in the sound intensity probe in such a way that the microphone measures the pressure exactly between these points. The pressure microphone is situated in the measuring point of the sound field.

In this method p(t) is measured directly by means of the pressure microphone.

The pressure difference microphone measures the pressure at two points with the distance $\Delta r$ and gives the pressure difference $\Delta p$.

The expression for the particle speed from method 1 is also usable in this case, since $$\Delta p = p_1(t) - p_2(t).$$

The result of the intensity measurement is thus $$I_r = p(t) \int \frac{p_1(t) - p_2(t)}{\Delta r_0 \cdot \mathrm{rho}_0} dt, \text{ where}$$

$\Delta r_0$ is the distance over which $\Delta p$ is measured (programmed into the measuring apparatus).

It can be shown that the intensity measured for a sine wave is:

$$I_r = \frac{P_0 (P_1 + P_2)}{4 \cdot \mathrm{rho}_0 \cdot c} \quad \frac{\sin(w \cos A \cdot \Delta r/2c)}{w \Delta r_0/2c}, \text{ where}$$

$P_0$ is the peak value of the pressure in the point for measuring the intensity and $P_1$, $P_2$ are the peak values of the pressures detected by the pressure gradient microphone.

If the probe is placed in a plane sound wave with its axis in the direction of propagation (A=0), and if the input of $\rho_0$ and $\Delta r_0$ corresponds to the values of $\rho$ and $\Delta r$, the left-hand fraction of the measuring result expresses the real intensity of the field while the right-hand fraction is the frequency characteristics of the system representing the measuring error in connection with this method, method 2.

In this embodiment the pressure microphone is insensitive to directions.

A pressure microphone is insensitive to directions in the plane where it measures the gradient—i.e. in the plane parallel to the two membranes in the probe.

The pressure gradient microphone can be varied in many ways without deviating from the idea of the invention. For example, the membrane need not necessarily be circular. It can also be oval or angular. The film of electret material is not necessarily placed on the back electrode. It can also be placed on the membrane.

I claim:

1. Pressure gradient microphone comprising a membrane and a back electrode, the surface of either the membrane or the back electrode being a film of an electrostatically charged material divided into n sections, characterised by one or several of the sections being permanently charged, the back electrode being electrically charged by means of an adjustable external voltage source.

2. Pressure gradient microphone according to claim 1, characterised by the adjustment being performed by subjecting all the membrane to an equal sound pressure and subsequently adjusting to minimum output signal.

3. Pressure gradient microphone according to claim 1, characterised by the chamber of the microphone being so small that the deflection of the membrane is considerably reduced under equal pressure on the two halves.

4. Pressure gradient microphone according to claim 1, characterised by the permanent electrostatic charges being only supplied to one half of the sections.

5. Pressure gradient microphone according to claim 1, characterised by four electrode parts covered by an electret material and interconnected two by two for indicating the pressure gradient in one plane.

6. Pressure gradient microphone according to any one of the claims 1–4 or 5 characterised by opposing a pressure microphone, a relatively thin gap existing between the microphones.

* * * * *

UNITED STATES PATENT AND TRADEMARK OFFICE

CERTIFICATE OF CORRECTION

PATENT NO. : 4,887,300

DATED : December 12, 1989

INVENTOR(S) : Erling Frederiksen

It is certified that error appears in the above-identified patent and that said Letters Patent is hereby corrected as shown below:

On the title page:

Add ---(30) Foreign Application Priority Data: July 17, 1986 (DK) 3406/86.--- and

Change "(75) Inventor: Frederiksen Erling, Holte, Denmark" to

---(75) Inventor: Erling Frederiksen, Holte, Denmark---

Signed and Sealed this

Second Day of July, 1991

*Attest:*

*Attesting Officer*

HARRY F. MANBECK, JR.

*Commissioner of Patents and Trademarks*